US011662131B1

(12) United States Patent
Black

(10) Patent No.: US 11,662,131 B1
(45) Date of Patent: May 30, 2023

(54) ASSEMBLY AND METHOD FOR COOLING AND DISPENSING DRAFT BEER AND OTHER BEVERAGES

(71) Applicant: BLACK RESEARCH AND DEVELOPMENT LLC, Tulsa, OK (US)

(72) Inventor: Thomas Black, Tulsa, OK (US)

(73) Assignee: Thomas Black, Tulsa, OK (US)

( * ) Notice: Subject to any disclaimer, the term of this patent is extended or adjusted under 35 U.S.C. 154(b) by 129 days.

(21) Appl. No.: 17/411,915

(22) Filed: Aug. 25, 2021

(51) Int. Cl.
*F25D 3/08* (2006.01)
*B67D 1/04* (2006.01)
*B67D 1/08* (2006.01)

(52) U.S. Cl.
CPC ..... *F25D 3/08* (2013.01); *B67D 1/0418* (2013.01); *B67D 1/0857* (2013.01); *F25D 2331/806* (2013.01)

(58) Field of Classification Search
CPC ... F25D 3/08; F25D 2331/806; B67D 1/0418; B67D 1/0857
USPC ..... 222/146.6, 146.1, 129.1; 285/399–402; 62/56, 389, 457.1, 457.3, 457.4
See application file for complete search history.

(56) References Cited

U.S. PATENT DOCUMENTS 1,513,637 A * 10/1924 Schwartz ..... B21D 51/40 29/512
2,014,492 A 5/1934 Burdge
2,182,116 A * 12/1939 Copeman ..... B67D 1/06 62/306
2,163,491 A 4/1958 Kauffman
3,231,143 A 1/1966 Cserny
3,232,489 A * 2/1966 Buffington ..... B67D 1/06 222/130
3,232,491 A * 2/1966 Hunt ..... B65D 81/3827 D9/418
3,308,636 A 3/1967 Schaaf
3,354,668 A 11/1967 Cserny
3,627,399 A 12/1971 Addison
4,247,134 A * 1/1981 Yergen ..... F16L 41/10 285/193
5,235,822 A 8/1993 Leonovich, Jr.
6,105,825 A 8/2000 Tatsuva
6,481,238 B1 * 11/2002 Jennings ..... F25D 3/06 62/457.4

(Continued)

FOREIGN PATENT DOCUMENTS

DE 4438619 5/1996

OTHER PUBLICATIONS

Jockey Box; Build Your Own Coil Jockey Box Conversion Kit (description and photos).

(Continued)

*Primary Examiner* — Lien M Ngo
(74) *Attorney, Agent, or Firm* — Dennis D. Brown; Brown Patent Law, P.L.L.C.

(57) ABSTRACT

An assembly and method for constructing or modifying a portable or non-portable ice chest, refrigerator, or other cooler for temporarily installing one or more faucets and related beverage dispensing equipment for cooling and dispensing beer or other beverages such that when cooler is not being used for dispensing beer or other beverages, the one or more faucets and the related dispensing equipment can be removed to allow the cooler to be used for other cooling services.

20 Claims, 9 Drawing Sheets

(56) References Cited

U.S. PATENT DOCUMENTS

| | | | | |
|---|---|---|---|---|
| 7,686,127 | B2 | 3/2010 | LeClear et al. | |
| 7,722,204 | B1 | 5/2010 | Sandberg | |
| 7,757,908 | B1 * | 7/2010 | Buhl, Jr. | B67D 1/06 62/239 |
| 7,886,936 | B2 | 2/2011 | Helline | |
| 8,157,136 | B2 | 4/2012 | Lamb | |
| 9,199,782 | B1 | 12/2015 | Cliatt | |
| 9,448,000 | B2 | 9/2016 | Patsis | |
| 9,676,604 | B2 * | 6/2017 | MacDonald | B67D 1/06 |
| 10,065,848 | B2 | 9/2018 | Volin | |
| 10,752,489 | B1 * | 8/2020 | Alger | B67D 1/0841 |
| 10,865,093 | B2 * | 12/2020 | Yang | B67D 1/0864 |
| 2010/0212351 | A1 | 8/2010 | Chapin | |
| 2011/0215114 | A1 * | 9/2011 | Liccioni | B67D 3/0038 222/185.1 |
| 2012/0024896 | A1 | 2/2012 | Scobey | |
| 2015/0368085 | A1 * | 12/2015 | Bond | B67D 3/0025 222/146.6 |
| 2016/0325978 | A1 | 11/2016 | Lehman | |
| 2017/0362072 | A1 * | 12/2017 | Garcia | B67D 1/00 |

OTHER PUBLICATIONS

Kegerator; Wide Single Tap Stainless Steel Commercial/Residential Kegerator (description and photo).
Portable Kegerators; The Coolerator Kegerator; Super Cooler Kegerator; My Friend III Kegerator (description and photos).
Keezer (photos).
DIY Portable Kegerator (photos).

* cited by examiner

ASSEMBLY AND METHOD FOR COOLING AND DISPENSING DRAFT BEER AND OTHER BEVERAGES

FIELD OF THE INVENTION

The present invention relates to assemblies and methods for constructing or modifying a portable or stationary ice chest, refrigerator, or other cooler for temporarily installing one or more faucets and related beverage dispensing equipment for cooling and dispensing beer or other beverages such that when the cooler is not being used for dispensing beer or other beverages, the one or more faucets and the related dispensing equipment can be removed to allow the cooler to be used for other cooling services.

BACKGROUND OF THE INVENTION

A draft beer system for dispensing beer on tap from a keg or other container will typically comprise: at least one faucet for pouring the beer; a faucet shank or faucet tower for mounting the faucet; a $CO_2$ tank for pressuring the beer out of the keg or other container and for maintaining carbonation; a pressure regulator for the $CO_2$; and a connector for the keg or other container for attaching both (a) a liquid hose or other conduit which extends to the connector from the faucet shank or faucet tower and (b) a $CO_2$ hose or other conduit which extends to the connector from the $CO_2$ tank. Unlike air-pump dispensing systems which are the staple of most frat parties, $CO_2$ systems preserve the quality and taste of the beer, maintain carbonation, and prevent the beer from spoiling (which quickly occurs when the beer is exposed to air).

A need exists for an improved portable draft beer system for dispensing draft beer on tap on the patio, at the lake, at tailgating parties, and elsewhere. The portable draft beer systems currently available in the art are expensive to purchase and have other significant disadvantages and shortcomings. For example, the current portable systems require the use of dedicated ice chests, refrigerators, or other coolers which cannot be used for other cooling services when not being used for cooling and dispensing beer. Also, when not being used for dispensing beer, these prior systems with their dedicated coolers take up a significant amount of storage space. In addition, the prior systems are difficult to clean.

A need also exists for a much less expensive option which would allow the user to have both (i) a portable draft beer system for temporary use on the patio, at the pool, or at remote locations outside of the home and (ii) an attractive and more permanent non-portable system installed, for example, at a bar in the home or in the kitchen. Unfortunately, due to the cost of the separate sets of the faucets, connectors, shanks, towers, etc. required for assembling two systems, the cost of owning both a portable draft beer dispensing system and a more permanent non-portable draft beer dispensing system is prohibitive for most people.

In addition, there is a need for (a) an improved dispensing system of the same type discussed above which can also be used for dispensing soda and other beverages and (b) an improved assembly and method for converting an existing portable or non-portable ice chest, refrigerator, or other cooler for use in a dispensing system.

SUMMARY OF THE INVENTION

The present invention provides an assembly and method for a beverage dispensing system which satisfy the needs and alleviate the problems discussed above. The inventive system and method allow the faucet, tower, connector, and other dispensing equipment to be conveniently removed from the ice chest, refrigerator, freezer or other cooler in a manner such that (a) the cooler can be used for other needed purposes such as cooling food, beverages, or other items and (b) the system components can be more conveniently stored if needed. The ability to conveniently remove and reinstall the faucet and other system components also allows the user to transfer the same components from a portable dispensing system to a non-portable dispensing system, and vice versa; thereby significantly reducing the total cost of having two systems. In addition, the inventive assembly and method can be used for (i) converting existing portable or non-portable ice chests, refrigerators, freezers or other coolers for use in the inventive dispensing system and (ii) dispensing soda and other beverages. The beverage dispensing system provided by the present invention is also easier to clean.

In one aspect, there is provided an assembly for removably installing a beverage dispensing system in a cooler. The assembly preferably comprises (i) a receiving bracket and (ii) a faucet mounting plate having a faucet assembly mounted thereon. The receiving bracket is preferably placed, formed, or placeable in an opening provided through a lid, door, side wall, or top wall of the cooler. The receiving bracket preferably comprises a passageway which extends longitudinally through the receiving bracket from an outer face to a rearward end of the receiving bracket. The passageway preferably comprises a forward recess having a depth which extends rearwardly into the passageway from the outer face of the receiving bracket to an interior shoulder in the passageway, the interior shoulder substantially surrounding the passageway and the interior shoulder being positioned forwardly of or at the rearward end of the receiving bracket. The faucet mounting plate has an outer face and a rearward face and is preferably removably receivable in the forward recess of the passageway of the receiving bracket such that a peripheral portion of the rearward face of the faucet mounting plate is positioned on or over the interior shoulder of the passageway.

In another aspect, there is provided a method of adapting a cooler for dispensing a beverage. The method preferably comprises the steps of: (a) forming an opening through a lid, door, side wall, or top wall of the cooler; (b) installing a receiving bracket in the opening, the receiving bracket comprising a passageway which extends longitudinally through the receiving bracket from an outer face to a rearward end of the receiving bracket, the outer face comprising a radially extending outer flange which substantially surrounds an open forward end of the passageway, and the passageway comprising a forward recess having a depth which extends rearwardly into the passageway from the outer face of the receiving bracket to an interior shoulder in the passageway, the interior shoulder substantially surrounding the passageway and the interior shoulder being positioned forwardly of or at the rearward end of the receiving bracket; (c) installing a faucet assembly on a mounting plate; (d) connecting a hose or other conduit between the faucet assembly and a beverage container; (e) before or after step (d), placing the beverage container in the cooler such that, after steps (d) and (e), the hose or other conduit extends through the passageway of the receiving bracket from the beverage container, which is positioned in the cooler, to the faucet assembly which is installed on the mounting plate, the mounting plate being located outside of the cooler; and (f) removably locking the mounting plate, with the faucet assembly installed thereon, in the forward recess of the passageway of the receiving bracket.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
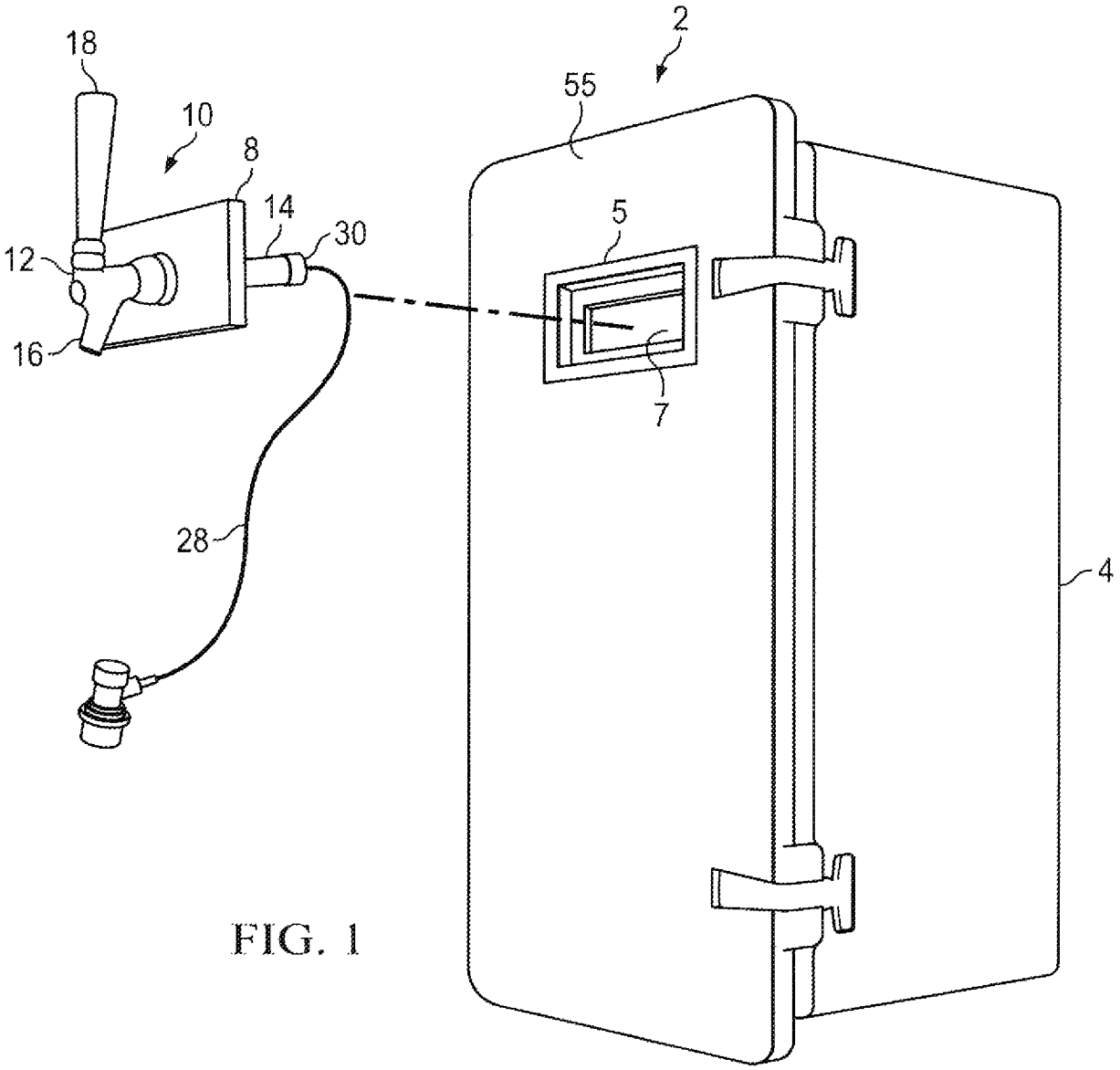
FIG. 1 is a perspective view of an embodiment 2 of the inventive assembly for removably installing a beverage dispensing system 3 in a cooler 4.
Figure 2:
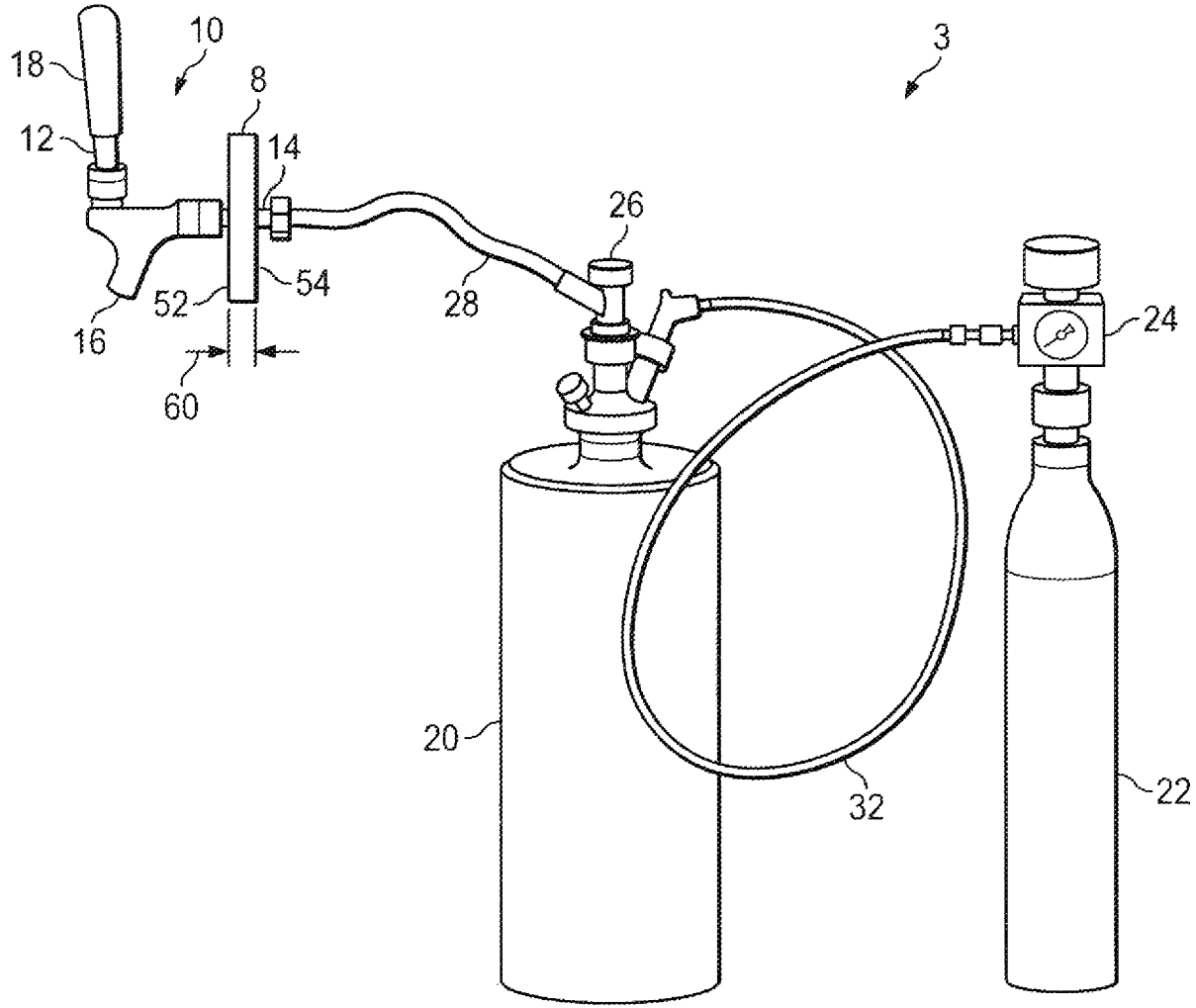
FIG. 2 illustrates a beverage dispensing system 3 which is removably installable in the cooler 4 using the inventive assembly 2.
Figure 3:
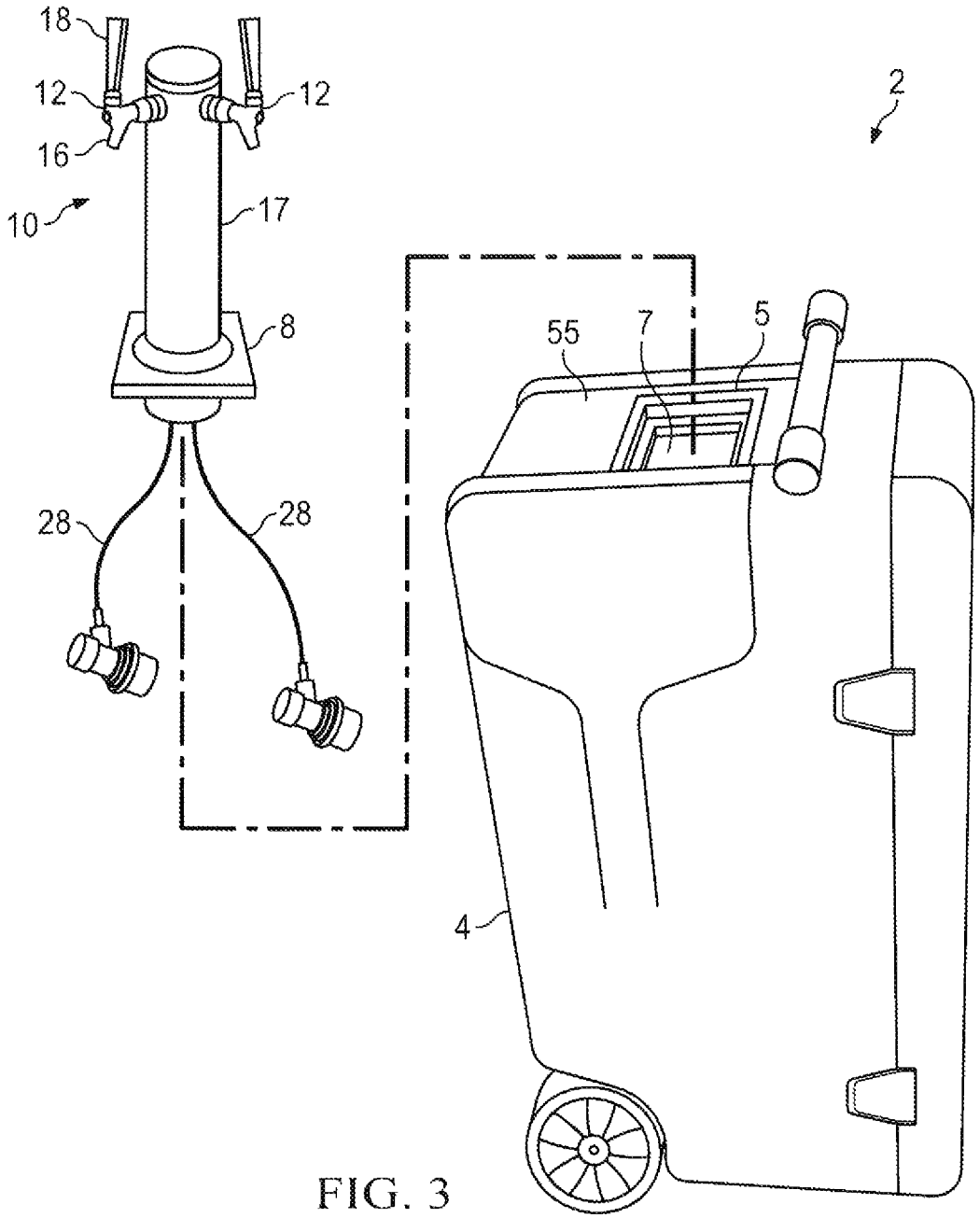
FIG. 3 is a perspective view of the inventive assembly 2 which includes a faucet tower 17.
Figure 4:
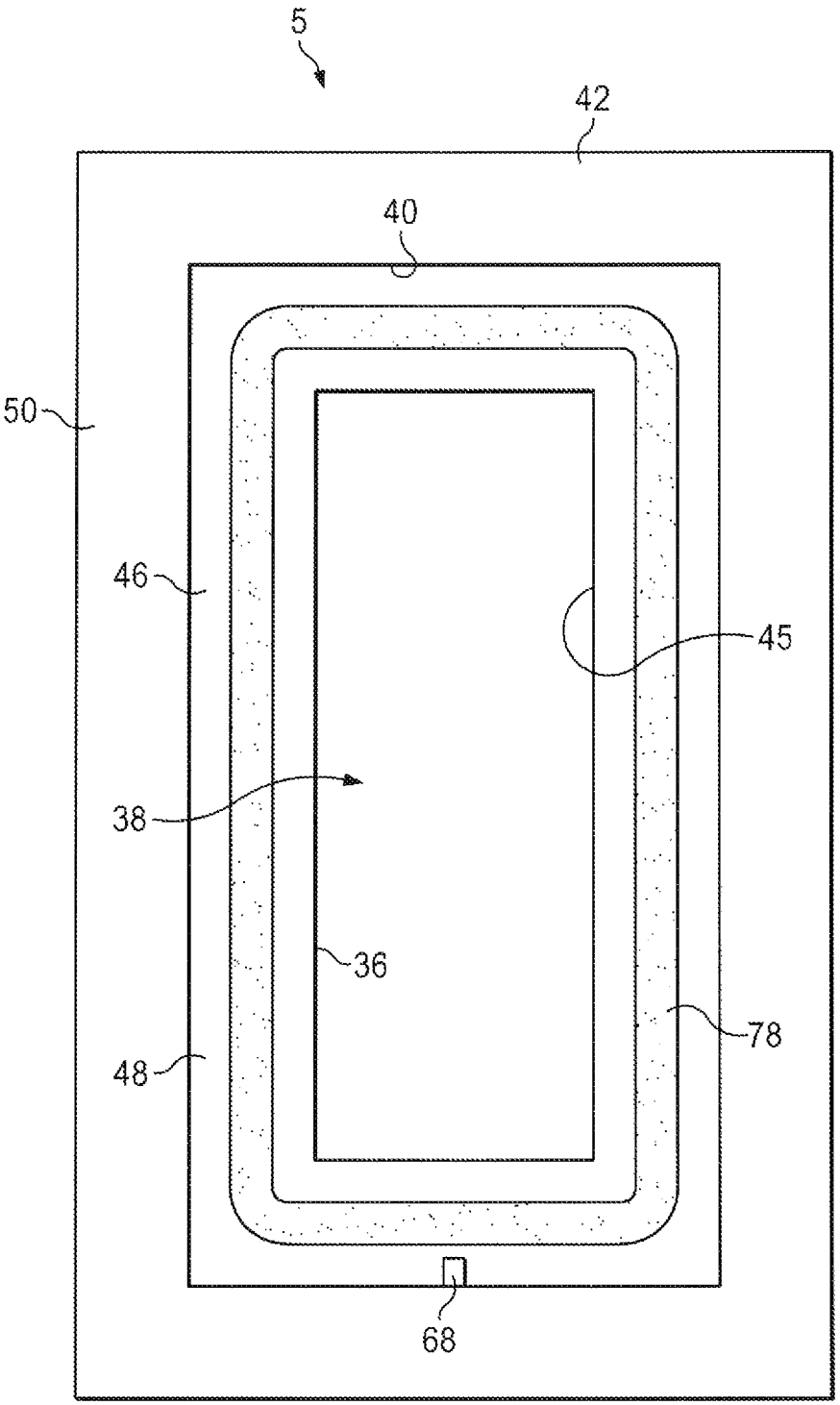
FIG. 4 is an elevational front view of a receiving bracket 5 used in the inventive assembly 2.
Figure 5:
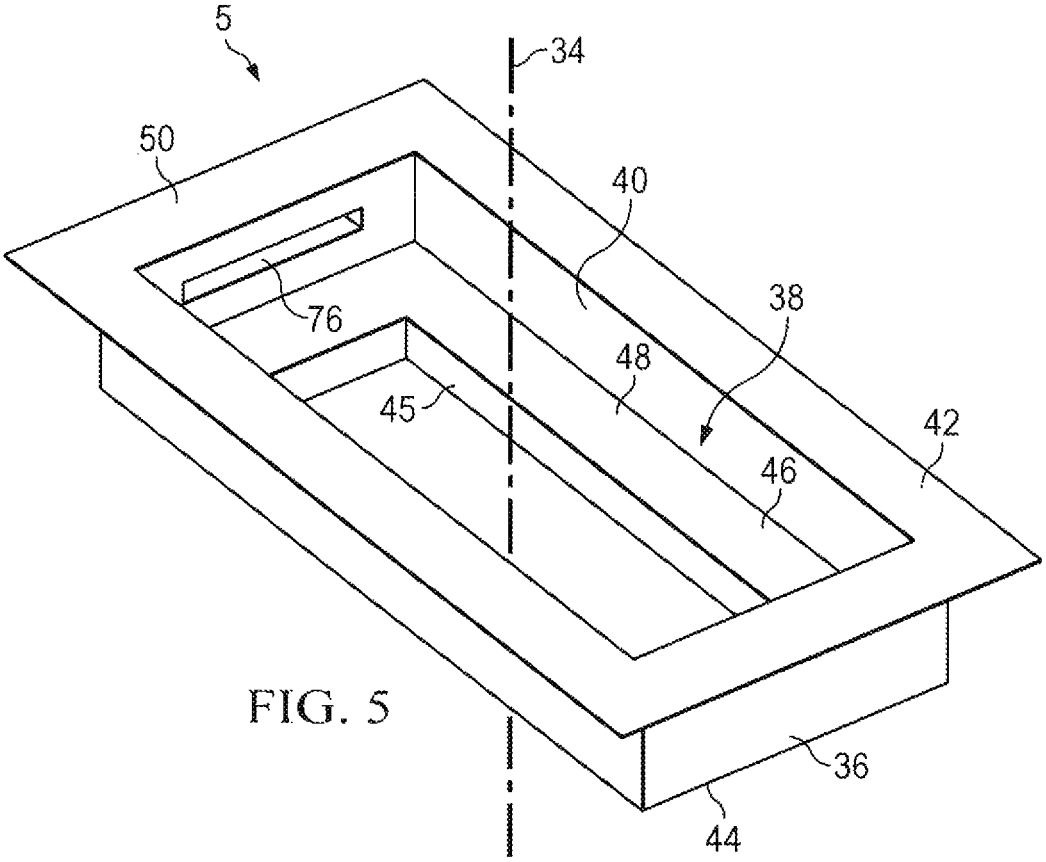
FIG. 5 is a perspective view of the receiving bracket 5.
Figure 6:
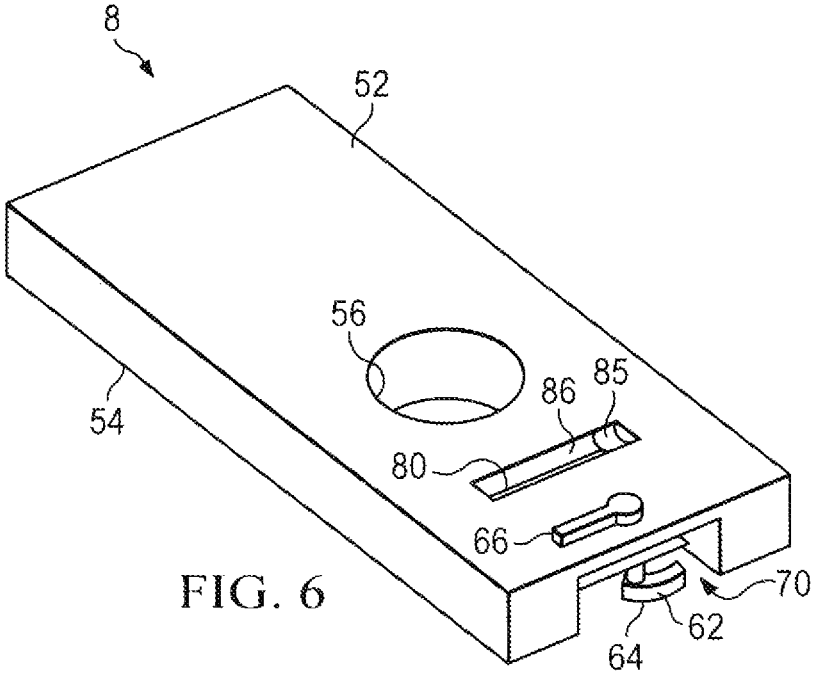
FIG. 6 is a perspective view of a faucet mounting plate 8 used in the inventive assembly 2.
Figure 7:
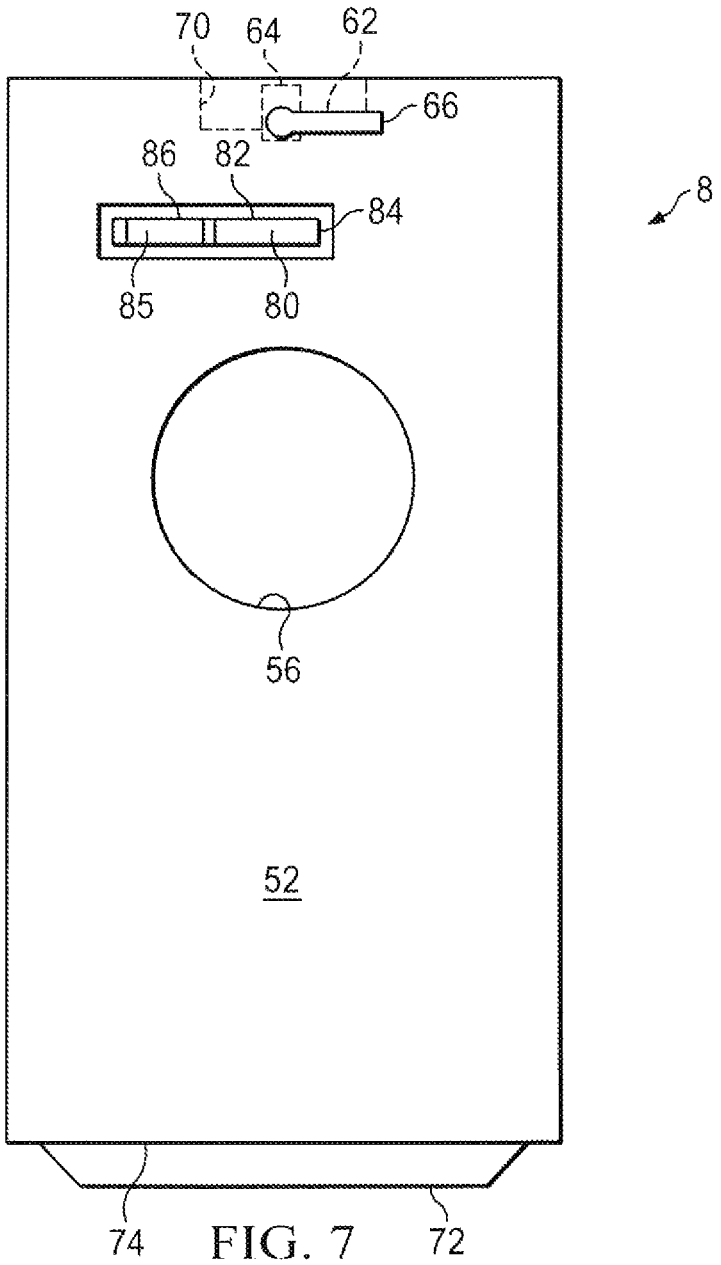
FIG. 7 is an elevational front view of the faucet mounting plate 8.
Figure 8:
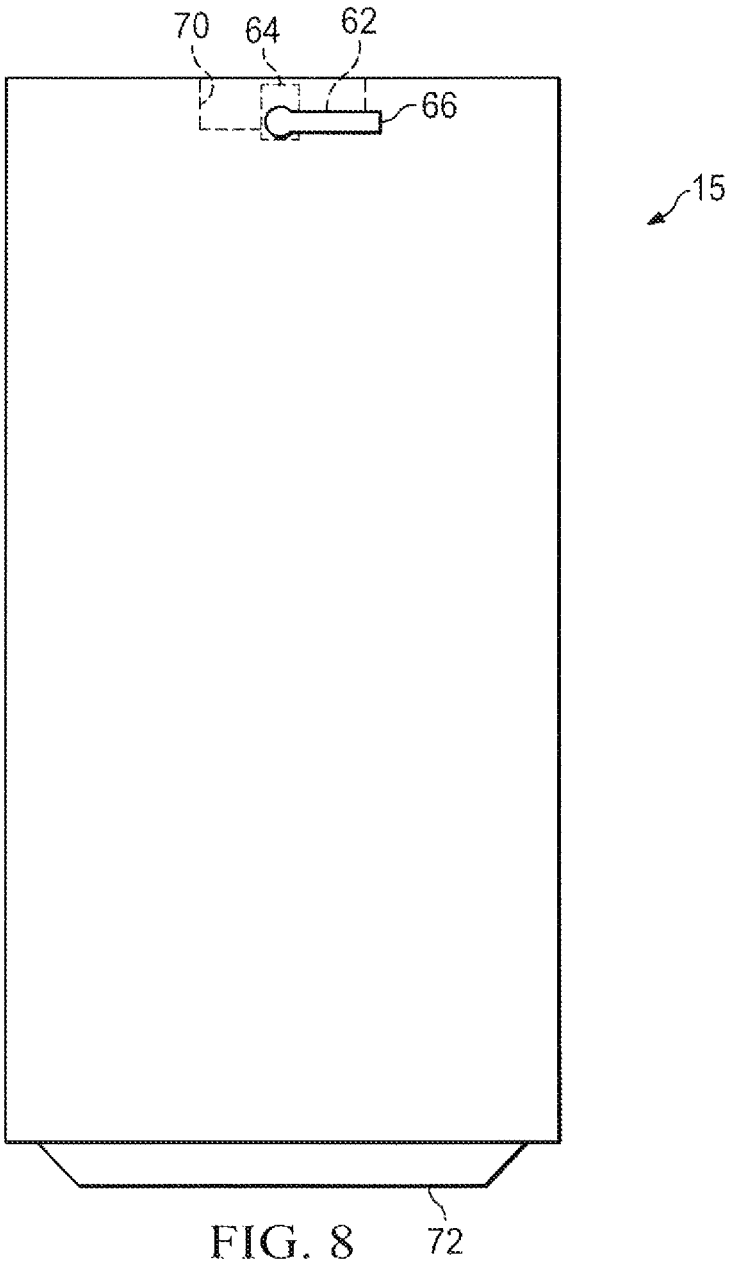
FIG. 8 is an elevational front view of a blank replacement plate 15 used in the inventive assembly 2.

An embodiment 2 of the inventive assembly for installing a beverage dispensing system 3 in a cooler 4 is illustrated in FIGS. 1-8. The inventive assembly 2 preferably comprises: a receiving bracket 5 which is received in an opening 7 through a lid, door, side wall, or top wall of the cooler 4; a faucet mounting plate 8 which is removably receivable in the receiving bracket 5; and at least one replacement plate 15 which is removably receivable in the receiving bracket 5 when the faucet mounting plate 8 is not in use. The faucet mounting plate 8 has a faucet assembly 10 mounted therein which preferably comprises at least one faucet 12 and a faucet shank 14 or tower 17. The faucet 12 has a spout 16 and a handle 18.

The inventive assembly 2 preferably also comprises: a keg or other beverage container 20 which is removably positionable in the cooler 4; a $CO_2$ tank 22 which will also typically be positioned in the cooler 4 with the beverage container 20; a pressure regulator 24 for the $CO_2$ tank 22; a connector 26 on the beverage container 20; a beverage hose or other conduit 28 which is removably connected between the rearward end 30 of the faucet shank 14, or the tower 17, and a beverage port on the connector 26; and a $CO_2$ hose or other conduit 32 which is removably connected between the pressure regulator 24 and a $CO_2$ port on the connector 26.

As used herein and in the claims, unless otherwise expressly stated, the term "cooler" refers to and includes any type of portable or non-portable ice chest, refrigerator, freezer, or other cooler used for cooling food, beverages, or other items.

The receiving bracket 5 can be formed in or can be insertable and installable in the lid, door, side wall, or top wall of the cooler 4. The receiving bracket 5 preferably comprises: a longitudinal axis 34; a longitudinally extending passageway 38; a longitudinally extending side wall 36 which substantially surrounds (i.e., extends entirely around or extends around at least 85% of the circumference of) the longitudinally extending passageway 38; an outer opening 40 of the passageway 38 provided in the outer face 42 of the receiving bracket 5; a rearward opening 45 of the passageway 38 provided in the rearward end 44 of the receiving bracket 5; a forwardly facing interior shoulder 46 provided in the passageway 38 which substantially surrounds (i.e., extends entirely around or extends around at least 85% of the circumference of) the passageway 38 and is positioned either between the outer face 42 and the rearward end 44 of the receiving bracket 5 or at the rearward end 44 of the receiving bracket 5; and a forward recess 48 formed in the passageway 38 which has a depth extending rearwardly into the passageway 38 from the outer face 42 of the receiving bracket 5 to the interior shoulder 46. The outer face 42 of the receiving bracket 5 also preferably includes a radially extending outer flange 50 which substantially surrounds (i.e., extends entirely around or extends around at least 85% of the circumference of) the outer opening 40 of the passageway 38.

When the receiving bracket 5 is received in the opening 7 of the lid, door, side wall, or top wall of the cooler 4, the receiving bracket 5 is preferably bonded in place in the opening 7 using an epoxy or other bonding or adhesive material applied (i) between the radial outer flange 50 of the receiving bracket 5 and the surface 55 of the lid, door, side wall, or top wall of the cooler 4 which surrounds the opening 7 and/or (ii) between the exterior of the side wall 36 of the receiving bracket 5 and the interior wall of the opening 7 formed through the lid, door, side wall, or top wall of the cooler 4. Alternatively, or in addition, the receiving bracket 5 can be secured in the opening 7 using bolts or screws which extend through the radial outer flange 50 and extend into or through the lid, door, side wall, or top wall of the cooler 4 adjacent to the opening 7. In addition, a silicone seal or other seal element can be positioned between the radial outer flange 50 of the receiving bracket 5 and the surface 55 of the lid, door, side wall, or top wall of the cooler 4 which surrounds the opening 7.

The receiving bracket 5 can be formed of any suitable plastic, metal or other material and will preferably be formed of polyethylene or a similar polymer resin. In order to reduce thermal losses, if bolts or screws are used to secure the receiving bracket 5 in the opening 7 of the lid, door, side wall, or top wall of the cooler 4, the bolts or screws with preferably be polymer bolts or screws.

The faucet mounting plate 8 preferably comprises: an outer face 52; a rearward face 54; and a faucet mounting hole 56 which extends through the faucet mounting plate 8 from the outer face 52 to the rearward face 54. The faucet shank 14, when used, extends through and is retained in the faucet mounting hole 56 for (a) attaching the faucet 12 to the forward of the shank 14 on the outer face 52 of the mounting plate 8 and (b) attaching the beverage hose or other conduit 28 to the rearward end of the faucet shank 14. Alternatively, a faucet tower 17 can be attached on the outer face 52 of the faucet mounting plate 8 over the faucet mounting hole 56. The faucet tower 17 can comprise one, two, or more faucets 12 mounted on the tower 17 with separate beverage hoses or other conduits 28 preferably extending from the different faucets 12 for drawing beverages from different containers.

The faucet mounting plate 8 with the faucet assembly 10 mounted thereon is removably receivable in the forward recess 48 of the receiving bracket 5 such that a peripheral portion of the rearward face 54 of the faucet mounting plate 8 rests on or over the interior shoulder 46 of the passageway 38. The thickness 60 of the faucet mounting plate 8 from the outer face 52 to the rearward face 54 thereof is preferably substantially the same as (i.e., the same as or within ±5% of) the depth of the forward recess 48 of the receiving bracket 5 so that the outer face 52 of the faucet mounting plate 8 will preferably be substantially flush with outer opening 40 of the passageway 38 of the receiving bracket 5.

The faucet mounting plate 8 can be formed of plastic, metal, and/or any other material. The faucet mounting plate 8 will preferably be an insulated component comprised of polyethylene foam or other insulating material encased within a hard exterior layer of high-density polyethylene or other thermoplastic or thermoset material.

The faucet mounting plate 8 preferably also includes a locking mechanism 62 for removably locking the faucet mounting plate 8 in the forward recess 40 of the receiving bracket 5. By way of example, but not by way of limitation, the locking mechanism 62 will preferably be a cam latch which comprises: a cam locking element 64 which is rotatably positioned in a perimeter portion of the faucet mounting plate 8; a lever, knob, or other rotating element 66 which is rotatably positioned outside of the outer face 52 of the faucet mounting plate and is connected or otherwise mechanically linked to the cam locking element 64 for rotating the cam locking element 64 to and from a locking position and a releasing position; and a post, tab, or other cam engaging element 68 which is provided in the receiving bracket 5. When the cam locking element 64 is rotated to its locking position, the cam locking element 64 grasps, wedges under or around, or otherwise engages the cam engaging element 68 of the receiving bracket 5.

When the faucet mounting plate 8 is positioned in the forward recess 48 of the receiving bracket 5, the cam engaging element 68 of the receiving bracket 5 preferably extends into a recess 70 formed in the perimeter portion of the faucet mounting plate 8. In addition, the cam locking element 64 is preferably positioned in the recess 70, or at least extends into the recess 70 when it is rotated to its locking position, so that when the cam locking element 64 is rotated to its locking position, it engages the cam engaging element 68 for locking the faucet mounting plate 8 in the forward recess 48 of the receiving bracket 5.

Alternatively, the cam engaging element can comprise, or can be an element located in, an interior groove or recess formed in or through the side wall 36 of the forward recess portion 48 of the receiving bracket 5 so that the cam locking element 64 rotates outwardly into said interior groove or recess and engages the cam engaging element when the cam locking element 64 is rotated to its locking position.

In addition, the faucet mounting plate 8 preferable further comprises a retaining lip or tab 72 which projects from a peripheral side or edge 74 of the mounting plate 8 and is received in a correspondingly shaped and sized interior groove 76 formed in or through the side wall 36 of the forward recess portion 48 of the passageway 38 of the receiving bracket 5. The retaining lip or tab 72 preferably projects from the peripheral side or edge 74 of the mounting plate 8 which is opposite the cam latch or other locking mechanism 62. The retaining lip or tab 72 operates with the cam latch 62 to compress the peripheral portion of the rearward face 54 of the faucet mounting plate 8 against the interior shoulder 46 of the receiving bracket 5. A silicone seal or other sealing element 78 is preferably provided between the peripheral portion of the rearward face 54 of the faucet mounting plate 8 and the interior shoulder 46 of the receiving bracket 5 in order to provide an air-tight seal which prevents warm air from flowing into, or cool air from flowing out of, the cooler 4 around the faucet mounting plate 8.

The faucet mounting plate 8 can also comprise a tap lock 80. The tap lock 80 preferably comprises (a) a pivot arm 82 having a proximal end 84 which is pivotable connected to the faucet mounting plate 8 and (b) a C-shaped receiver 85 on the distal end of the pivot arm 82 which is sized and positioned to receive and hold the handle 18 of the faucet 12 when the faucet handle 18 is in its closed position and the tap lock 80 is pivoted outwardly to a locking position. When the tap lock 80 is not in use, it can be pivoted to an unlocked position in which the tap lock 80 is received in a slot or other recess 86 formed in the outer face 52 of the faucet mounting plate 8.

As indicated above, the inventive assembly 2 will preferably include one or more replacement plates 15 which can be removably received and locked in the forward recess 48 of the receiving bracket 5 in place of the faucet mounting plate 8. This allows the faucet mounting plate 8 with the faucet assembly 10 mounted thereon, along with the other components of the assembly 2, to be removed from the cooler 4 such that (a) the replacement plate 15 will seal the opening 7 in the cooler 4 to allow the cooler 4 to be used for other purposes and/or (b) the user can transfer the inventive assembly 2 to a different ice chest, refrigerator, freezer, or other cooler 4 having a receiving bracket 5 installed therein.

Preferably, the inventive assembly 2 will include at least one replacement plate 15 which is simply a blank plate for closing and sealing the opening 7 in the cooler 4. The blank replacement plate 15 will preferably be an insulated plate of the same size, shape and configuration as the faucet mounting plate 8 except that the blank replacement plate will not have a faucet mounting hole 56 provided therethrough and will not include a tap lock 80. The locking mechanism 62 and the retaining lip or tab 72 of the replacement plate 15 will preferably be the same as the locking mechanism 62 and the retaining lip or tab 72 used in the faucet mounting plate 8.

Alternatively, or in addition, the inventive assembly 2 can include one or more replacement plates having, e.g., a Bluetooth speaker, a battery pack, a solar panel, or other device mounted therein for use in remote locations, at the pool, on the patio, in the home, or elsewhere.

The receiving bracket 5 and the faucet mounting plate 8 of the inventive assembly 2, as well as the one or more replacement plates 15 if included, can be square or rectangular as illustrated in FIGS. 1-8, or can be circular or any other shape desired. In each case, except for the circular or other shape, the mounting brackets, faucet mounting plates, and replacement plates of the non-rectangular assemblies can be the same as the receiving bracket 5, the faucet mounting plate 8, and the replacement plate(s) 15 of the inventive assembly 2.

If a circular receiving bracket and faucet mounting plate are used, the locking mechanism 62 and the retaining lip 72 of the inventive assembly 2 can be replaced with two or more locking tabs which (a) extend radially from the faucet mounting plate and (b) are received in a corresponding number of interior grooves formed in or through the side wall of the forward recess of the receiving bracket. The tabs are received in the interior grooves by placing the circular faucet mounting plate in the forward recess of the receiving bracket and rotating the faucet mounting plate for a partial turn. In this embodiment, the faucet mounting plate will preferably have two opposing tabs which are received in two corresponding interior grooves in the receiving bracket by rotating the faucet mounting plate a quarter turn.

Figure 9:
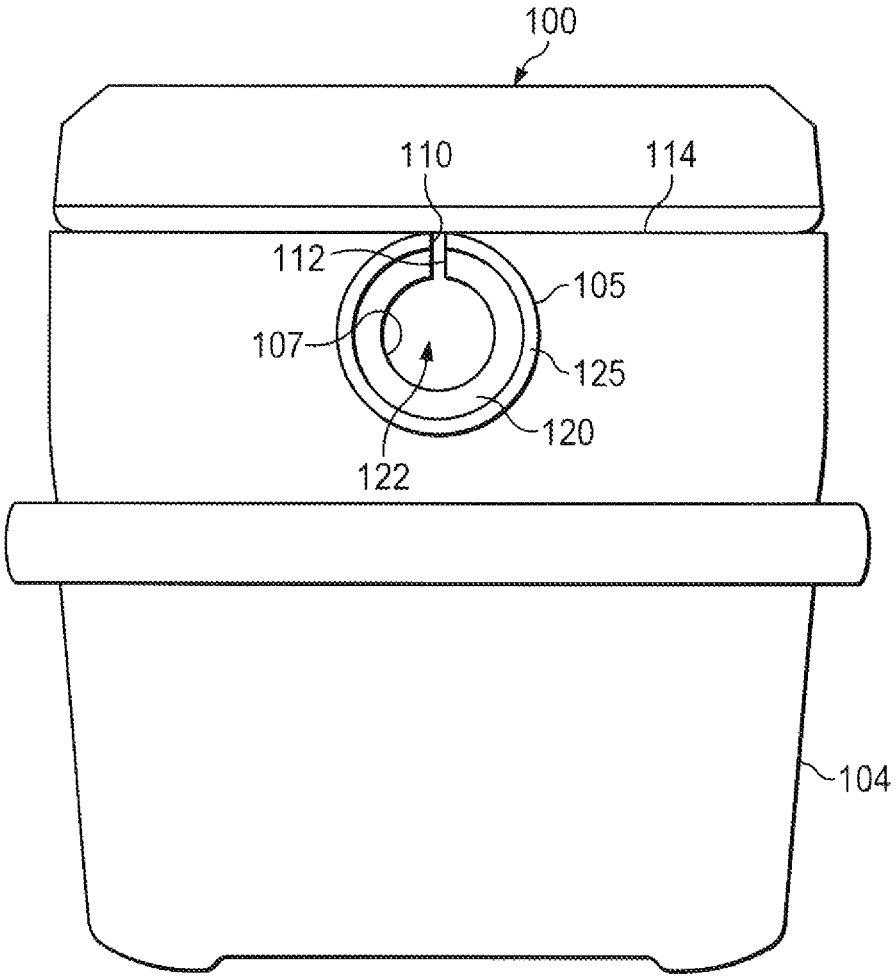
FIG. 9 is a top view of an alternative embodiment 100 of the inventive assembly for removably installing a beverage dispensing system in a cooler 104.
Figure 10:
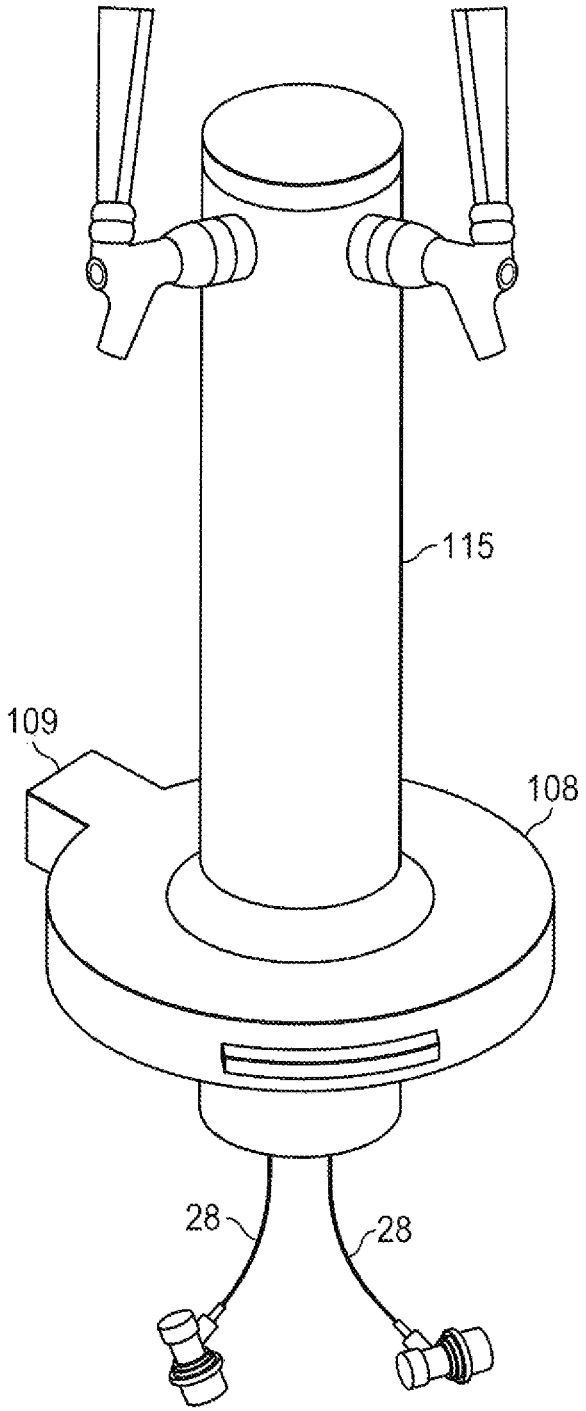
FIG. 10 is a perspective view of a faucet mounting plate 108 and faucet tower 115 used in the inventive assembly 100.

An alternative embodiment 100 of the inventive assembly is illustrated in FIGS. 9 and 10. Although being circular in shape, the inventive assembly 100 is identical to the inventive assembly 2 except that the receiving bracket 105 of the inventive assembly 100 includes a side slot 110 which mates with a corresponding slot opening 112 provided in the cooler 104. The slot opening 112 of the cooler 104 extends from the opening 107 provided through the lid, door, side wall, or top wall of the cooler 104 through a peripheral side, edge, or end 114 of the lid, door, side wall, or top wall of the cooler 104. The slot opening 110 of the receiving bracket 105 extends longitudinally along the side of the receiving backet 105 through both the outer and the rearward ends thereof, and also extends radially through the interior shoulder 120 and the radial outer flange 125 of the receiving bracket 105.

With the slot opening 110 of the receiving bracket 105 positioned adjacent to the slot opening 112 in the lid, door, side wall, or top wall of the cooler 104, the passageway 122 of the receiving bracket 105 is thereby placed in communication with the slot opening 112 of the cooler 104 to allow the one or more beverage hoses or conduits 28 connected between the faucet assembly 115 and the beverage container 20 to be delivered laterally into or out of the passageway 122 of the receiving bracket 105 through the slot opening 112 of the cooler 104 and through the slot opening 110 of the receiving bracket 105 without having to disconnecting the beverage hose(s) or other conduit(s) 28 from either the faucet assembly 115, which is mounted on the faucet mounting plate 108, or the beverage container 20. This is extremely convenient, for example, for transferring the entire inventive assembly, including the keg(s) or other beverage container(s) 20, from one cooler to another without having to disconnect and reconnect the beverage hose(s) 28.

The alternative embodiment 100 of the inventive assembly can also be square, rectangular, or any other desired shape. In the alternative embodiment 100, the faucet mounting plate 108 preferably includes a radially projecting structure 109 which extends outwardly from the faucet mounting plate 108 for covering the slot opening 110 of the receiving bracket 105 and the slot opening 112 of the cooler 4 when the faucet mounting plate 108 is received in the receiving bracket 105.

In the method of the present invention for installing the inventive beverage assembly 2, or one of the other embodiments of the inventive assembly discussed above, in an existing cooler 4, an opening 7 is formed through the lid, door, side wall, or the top wall of the cooler 4. The receiving bracket 5 is then inserted into the opening 7, preferably with a silicone seal or other sealing element which (i) extends around or substantially around (i.e., around at least 85% of the circumference of) the opening 7 and (ii) is positioned between the radial outer flange 50 of the receiving bracket 5 and the exterior surface 55 of the lid, door, side wall, or top wall of the cooler 4. A bonding material is preferably also applied between the radial outer flange 50 and the exterior surface 55 of the lid, door, side wall, or top wall to bond the receiving bracket 5 in place in the opening 7.

The inventive method also preferably comprises the steps of: (i) installing the faucet assembly 10 on the faucet mounting plate 8; (ii) placing the beverage container 20 in the cooler 4; (iii) connecting the one or more beverage hose(s) or other conduit(s) 28 to the faucet assembly 10 and to the keg or other beverage container 20 (i.e., connecting the beverage hose or other conduit 28 directly to the beverage container 20 or to a connector 26 or other device or hose which is connected to the beverage container 20) such that, with the faucet mounting plate 8 located outside of the cooler 4, the beverage hose(s) or other conduit(s) 28 extend(s) through the passageway 38 of the receiving bracket 5; placing the faucet mounting plate 8 with the faucet assembly 10 mounted thereon in the forward recess 48 of the receiving bracket 5 and positioning a silicone seal or other sealing element 78 between the peripheral portion of the rearward face of the mounting plate 8 and the interior shoulder 46 of the receiving bracket 5; and removably locking the faucet mounting plate 8 in place in the receiving bracket 5 using the locking mechanism 62.

The inventive method can further comprise the steps of (i) unlocking the faucet mounting plate 8 with the faucet assembly 10 mounted thereon, (ii) removing the faucet mounting plate 8 from the receiving bracket 5, and (iii) removably locking a blank or other replacement plate 15 in the forward recess 48 of the receiving bracket 5.

When the embodiment 100 of the inventive assembly is used, the inventive method of installing the inventive assembly 100 in an existing cooler 104 preferably also includes the steps of (i) forming the slot opening 112 in the cooler 104, (ii) forming the slot opening 110 in the receiving bracket 105, and (iii) positioning the slot opening 110 adjacent to the slot opening 112 to thereby place the passageway 122 of the receiving bracket 105 in communication with the slot opening 112 of the cooler 104. This allows the beverage hose or other conduit 28 to be laterally delivered into and out of the passageway 122 through the slot opening 112 of the cooler 104 and the slot opening 110 of the receiving bracket 105. Consequently, the keg or other beverage container 20 can be placed in the cooler 104 either before or after the beverage hose(s) or other conduit(s) 28 is/are connected between the faucet assembly 10 and the beverage container 20. Similarly, the beverage container 20 can be removed from the cooler 104 either with or without disconnecting the beverage hose(s) or other conduit(s) 28 from the beverage container 20 or the faucet assembly 10.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. An assembly for removably installing a beverage dispensing system in a cooler, the assembly comprising:

a receiving bracket which is placed, formed, or placeable in an opening provided through a lid, door, side wall, or top wall of the cooler, the receiving bracket comprising a passageway which extends longitudinally through the receiving bracket from an outer face to a rearward end of the receiving bracket, and the passageway comprising a forward recess having a depth which extends rearwardly into the passageway from the outer face of the receiving bracket to an interior shoulder in the passageway, the interior shoulder substantially surrounding the passageway and the interior shoulder being positioned forwardly of or at the rearward end of the receiving bracket and a faucet mounting plate with a faucet assembly mounted thereon, the faucet mounting plate having an outer face and a rearward face, the faucet mounting plate with the faucet assembly mounted thereon being removably receivable in the forward recess of the passageway of the receiving bracket with a peripheral portion of the rearward face of the faucet mounting plate being positioned on or over the interior shoulder of the passageway.

2. The assembly of claim 1 further comprising the faucet mounting plate having a thickness from the outer face of the faucet mounting plate to the rearward face of the faucet mounting plate which is substantially the same as the depth of the forward recess of the passageway of the receiving bracket.

3. The assembly of claim 1 comprising the faucet mounting plate with the faucet assembly mounted thereon further comprising:

the faucet mounting plate having a faucet mounting hole which extends through the faucet mounting plate from the outer face of the faucet mounting plate to the rearward face of the faucet mounting plate;

a faucet shank which extends through and is retained in the faucet mounting hole of the faucet mounting plate; and a faucet which is connected to any outer end of the faucet shank.

4. The assembly of claim 1 further comprising a sealing element which is positioned in sealing contact between the peripheral portion of the rearward face of the faucet mounting plate and the interior shoulder of the passageway of the receiving bracket when the faucet mounting plate with the faucet assembly mounted thereon is received in the forward recess of the passageway of the receiving bracket.

5. The assembly of claim 1 further comprising a cam latch which releasably locks the faucet mounting plate with the faucet assembly mounted thereon in the forward recess of the passageway of the receiving bracket.

6. The assembly of claim 5 further comprising the cam latch comprising:

a cam locking element which is rotatably positioned in a perimeter portion of the faucet mounting plate;

a lever, knob, or other rotating element which is connected to the cam locking element for rotating the cam locking element to and from a locking position and a releasing position;

the lever, knob, or other rotating element being positioned outside of the outer face of the faucet mounting plate; and a cam engaging element, provided in the receiving bracket, which is engaged by the cam locking element to releasably lock the faucet mounting plate in the forward recess of the passageway of the receiving bracket when the cam locking element is rotated to the locking position.

7. The assembly of claim 6 further comprising:

the cam engaging element being a post or tab which is positioned in the forward recess of the passageway of the receiving bracket;

the cam engaging element extending into a recess in the perimeter portion of the faucet mounting plate when the faucet mounting plate with the faucet assembly mounted thereon is received in the forward recess of the passageway of the receiving bracket; and the cam locking element being positioned in the recess in the perimeter portion of the faucet mounting plate, or the cam locking element at least extending into the recess in the perimeter portion of the faucet mounting plate when the cam locking element is rotated to the locking position.

8. The assembly of claim 6 further comprising a replacement plate, having no faucet mounted thereon, which is removably receivable in the forward recess of the passageway of the receiving bracket when the faucet mounting plate with the faucet assembly mounted thereon is not in use, the replacement plate comprising:

a cam locking element which is rotatably positioned in a perimeter portion of the replacement plate;

a lever, knob, or other rotating element which is connected to the cam locking element of the replacement plate for rotating the cam locking element of the replacement plate to and from a locking position and a releasing position;

the lever, knob, or other rotating element of the replacement plate being positioned outside of an outer face of the replacement plate; and the cam locking element of the replacement plate engaging the cam engaging element of the receiving bracket to releasably lock the replacement plate in the forward recess of the passageway of the receiving bracket when the replacement plate is received in the forward recess of the passageway and the cam locking element of the replacement plate is rotated to the locking position of the cam locking element of the replacement plate.

9. The assembly of claim 8 further comprising the replacement plate being an insulated blank plate for closing the passageway of the receiving bracket when the faucet mounting plate with the faucet assembly mounted thereon is not in use.

10. The assembly of claim 5 further comprising the faucet mounting plate having a lip or tab which projects from a peripheral location of the faucet mounting plate and is received in an interior groove in a side wall of the forward recess of the passageway of the receiving bracket when the faucet mounting plate with the faucet assembly mounted thereon is received in the forward recess of the passageway.

11. The assembly of claim 1 further comprising the faucet assembly being a tap tower.

12. The assembly of claim 1 further comprising:

a slot opening of the cooler which extends from the opening provided through the lid, door, side wall, or top wall of the cooler through a peripheral side, edge, or end of the lid, door, side wall, or top wall of the cooler;

a slot opening of the receiving bracket which extends longitudinally along and through a side of the receiving backet; and the slot opening of the receiving bracket being positioned adjacent to the slot opening of the cooler when the receiving bracket is placed in the opening provided through the lid, door, side wall, or top wall of the cooler so that the passageway of the receiving bracket is placed in communication with the slot opening of the cooler to allow a beverage hose or conduit which is connected between the faucet assembly and a beverage container to be delivered laterally into or out of the passageway of the receiving bracket through the slot opening of the cooler and through the slot opening of the receiving bracket without disconnecting the beverage hose or other conduit from either the faucet assembly or the beverage container.

13. The assembly of claim 1 further comprising:

the faucet mounting plate being circular in shape;

the faucet mounting plate having two or more tabs which extend radially from the faucet mounting plate; and the forward recess of the passageway of the receiving bracket having grooves formed therein for receiving the two or more tabs of the faucet mounting plate when the faucet mounting plate is received in the receiving bracket and rotated for a partial turn.

14. The assembly of claim 1 further comprising a tap lock which is pivotably connected to the faucet mounting plate with the faucet assembly mounted thereon, the tap lock being pivotable to and from (i) an unlocked position in which the tap lock is received in a recess formed in the outer face of the faucet mounting plate and (ii) a locked position in which the tap lock engages a handle of a faucet of the faucet assembly and holds the handle of the faucet in a closed position.

15. A method of adapting a cooler for dispensing a beverage comprising:

a) forming an opening through a lid, door, side wall, or top wall of the cooler;

b) inserting a receiving bracket in the opening, the receiving bracket comprising a passageway which extends longitudinally through the receiving bracket from an outer face to a rearward end of the receiving bracket, the outer face comprising a radially extending outer flange which substantially surrounds an open forward end of the passageway, and the passageway comprising a forward recess having a depth which extends rearwardly into the passageway from the outer face of the receiving bracket to an interior shoulder in the passageway, the interior shoulder substantially surrounding the passageway and the interior shoulder being positioned forwardly of or at the rearward end of the receiving bracket;

c) installing a faucet assembly on a mounting plate;

d) connecting a hose or other conduit between the faucet assembly and a beverage container;

e) before or after step (d), placing the beverage container in the cooler such that, after steps (d) and (e), the hose or other conduit extends through the receiving bracket from the beverage container, which is positioned in the cooler, to the faucet assembly, which is installed on the mounting plate and is located outside of the cooler; and f) removably locking the mounting plate, with the faucet assembly installed thereon, in the forward recess of the passageway of the receiving bracket.

16. The method of claim 15 further comprising:

positioning a seal between the radially extending outer flange of the receiving bracket and a surface of the lid, door, side wall, or top wall of the cooler which surrounds the opening through the lid, door, side wall, or top wall of the other cooler and positioning a seal between a peripheral portion of a rearward face of the mounting plate and the interior shoulder of the passageway of the receiving bracket.

17. The method of claim 15 further comprising bonding the radially extending outer flange of the receiving bracket to a surface of the lid, door, side wall, or top wall of the cooler which surrounds the opening through the lid, door, side wall, or top wall.

18. The method of claim 15 further comprising locking the mounting plate in the forward recess of the passageway of the receiving bracket in step (f) using a cam latch comprising:

a cam locking element which is rotatably positioned in a perimeter portion of the mounting plate;

a lever, knob, or other rotating element which is (i) positioned outside of an outer face of the mounting plate, (ii) connected or mechanically linked to the cam locking element, and (iii) used in step (f) to rotate the cam locking element to a locking position; and a cam engaging element, provided in the receiving bracket, which is engaged by the cam locking element in step (f) to releasably lock the mounting plate in the forward recess of the passageway of the receiving bracket.

19. The method of claim 15 further comprising the steps of:

removing the mounting plate, with the faucet assembly installed thereon, from the forward recess of the passageway of the receiving bracket, and removing the hose or other conduit from the passageway of the receiving bracket and removably locking a plate having no faucet mounted thereon in the forward recess of the passageway of the receiving bracket.

20. The method of claim 15 further comprising:

forming a slot opening in the lid, door, side wall, or top wall of the cooler which extends from the opening in the lid, door, side wall or top wall through a peripheral side, edge, or end of the lid, door, side wall, or top wall of the cooler;

forming a slot opening which extends longitudinally along and through a side of the receiving bracket, and which also extends radially through the radially extending outer flange of the receiving bracket; and positioning the slot opening formed in the receiving bracket adjacent to the slot opening formed in the lid, door, side wall, or top wall of the cooler in step (b) to place the passageway of the receiving bracket in communication with the slot opening formed in the lid, door, side wall, or top wall of the cooler.

* * * * *